US006591983B1

(12) United States Patent
Chang

(10) Patent No.: US 6,591,983 B1
(45) Date of Patent: Jul. 15, 2003

(54) GOLF BAG TILTING STRUCTURE

(76) Inventor: Ruey-Yang Chang, P.O. Box 453, Taichung (TW)

( * ) Notice: Subject to any disclaimer, the term of this patent is extended or adjusted under 35 U.S.C. 154(b) by 0 days.

(21) Appl. No.: 10/174,865

(22) Filed: Jun. 20, 2002

(51) Int. Cl.[7] ..... A63B 55/04
(52) U.S. Cl. ..... 206/315.7; 248/96
(58) Field of Search ..... 248/96; 206/315.7, 206/315.3

(56) References Cited

U.S. PATENT DOCUMENTS 5,340,063 A * 8/1994 Hsieh ..... 248/96
5,464,180 A * 11/1995 Cheng ..... 248/96
6,220,433 B1 * 4/2001 Kang ..... 206/315.7
6,241,201 B1 * 6/2001 Wang ..... 206/315.7 X
6,494,416 B2 * 12/2002 Wang ..... 248/96

* cited by examiner

*Primary Examiner*—Tri M. Mai
(74) *Attorney, Agent, or Firm*—Harrison & Egbert

(57) ABSTRACT

A golf bag tilting structure includes a base, an actuating plate, and a leg frame. The base is provided with a level portion, and an inclined portion. The level portion is provided with a U-shaped retaining projection. The actuating plate is provided with a hooked portion and a tongue. The actuating plate is fastened detachably and movably to the base such that the tongue of the actuating plate is retained by the U-shaped retaining projection, and such that the hooked portion of the actuating plate is engaged with a connection rod of the leg frame, thereby enabling the actuating plate to actuate the leg frame to spread out to support the golf bag slantingly on a surface.

1 Claim, 8 Drawing Sheets

GOLF BAG TILTING STRUCTURE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a golf bag, and more particularly to a tilting structure of the golf bag.

BACKGROUND OF THE INVENTION

As shown in FIGS. 1–3, a prior art golf bag 10 is provided with a tilting structure comprising a base 20, an actuating plate 26, and a leg frame 30. The base 20 is provided in the underside with a level surface 21 and an inclined surface 22. Located at the junction between the level surface 21 and the inclined surface 22 is a pivoting plate 24 which is fastened with the base 20 by two rivets 23. The pivoting plate 24 is provided in the underside with two pivoting lugs 241 for pivoting the actuating plate 26 in conjunction with a pivot 25. The actuating plate 26 is opposite in location to the inclined surface 22 of the base 20 and is engaged with a connection rod 31 of the leg frame 30. With the weight of the golf bag 10 and the external force exerting on the golf bag 10, the prior art golf bag 10 can be tilted such that the golf bag 10 is supported by the the base 20 and the leg frame 30 on a surface. As the golf bag 10 is under pressure, the actuating plate 26 is forced to turn on the pivot 25 so as to come in contact with the inclined surface 22 of the base 20, thereby actuating the connection rod 31 of the leg frame 30. As a result, the leg frame 30 expands to support the golf bag 10 on the surface in an inclined position, as shown in FIG. 3.

The prior art golf bag tilting structure is defective in design because it is complicated in construction, and because the actuating plate 26 and the pivoting plate 24 cannot be easily replaced in the event that they are damaged.

BRIEF SUMMARY OF THE INVENTION

The primary objective of the present invention is to provide a golf bag with a tilting structure which is simple in construction and cost-effective.

It is another objective of the present invention to provided a golf bag with a tilting structure which comprises a base, and actuating plate detachably fastened with the base.

In keeping with the principle of the present invention, the foregoing objectives of the present invention are attained by a golf bag tilting structure comprising a base, an actuating plate, and a leg frame. The base is provided in the underside with a retaining portion. The actuating plate is provided with a hooked portion to engage a connection rod of the leg frame, and a retaining portion by which the actuating plate is detachably fastened with the retaining portion of the base in conjunction with a plurality of fastening screws.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
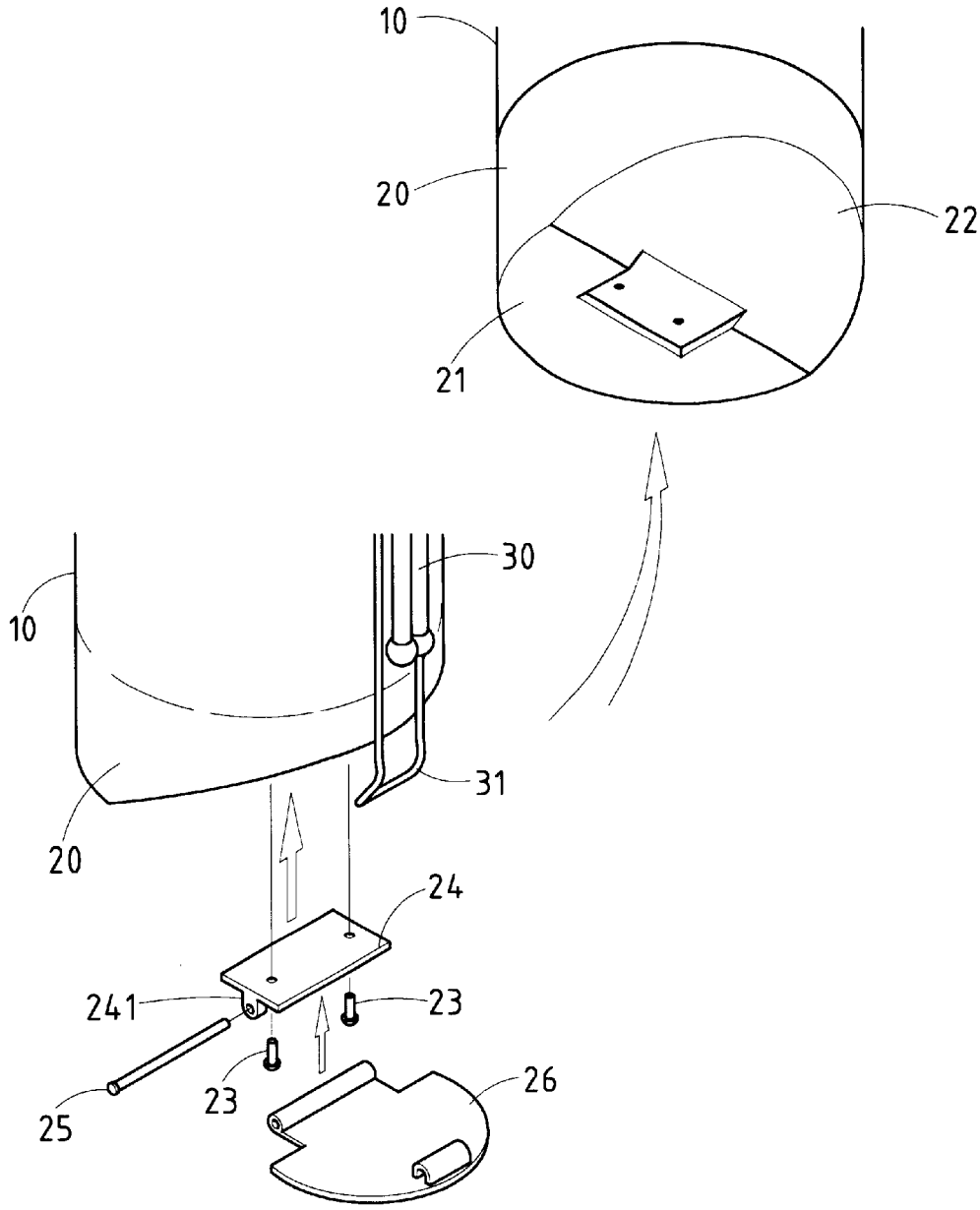
FIG.1 PRIOR ART
FIG. 1 shows an exploded perspective view of a prior art golf bag tilting structure.
Figure 2:
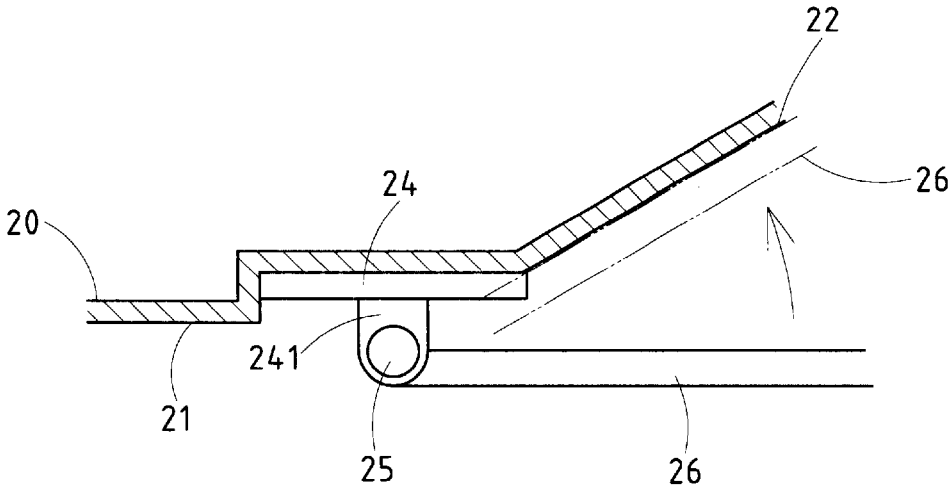
FIG.2 PRIOR ART
FIG. 2 shows a schematic plan view of the prior art golf bag tilting structure in action.
Figure 3:
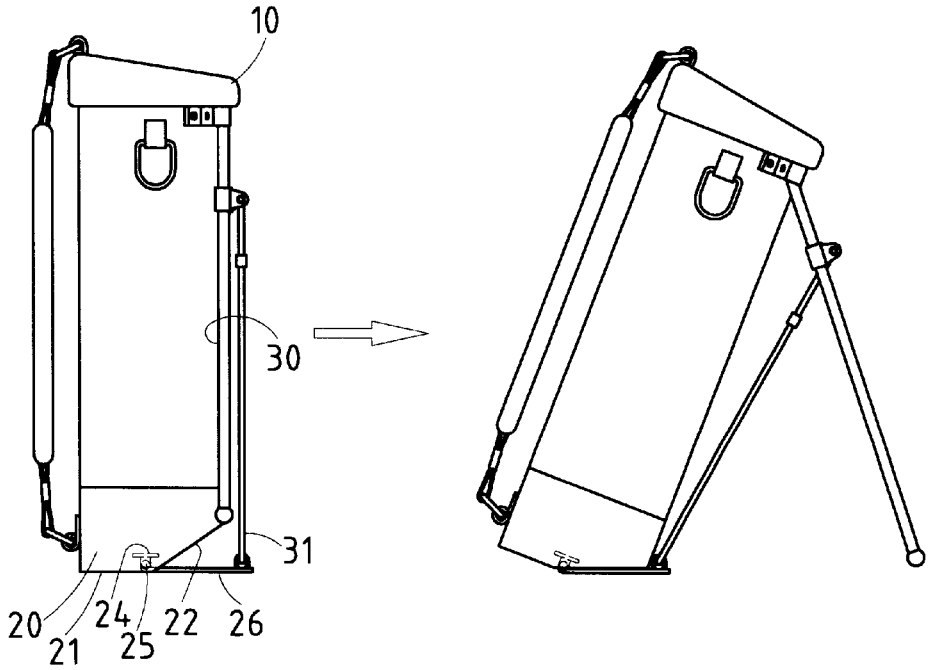
FIG.3 PRIOR ART
FIG. 3 shows a schematic view of the prior art golf bag being tilted.
Figure 4:
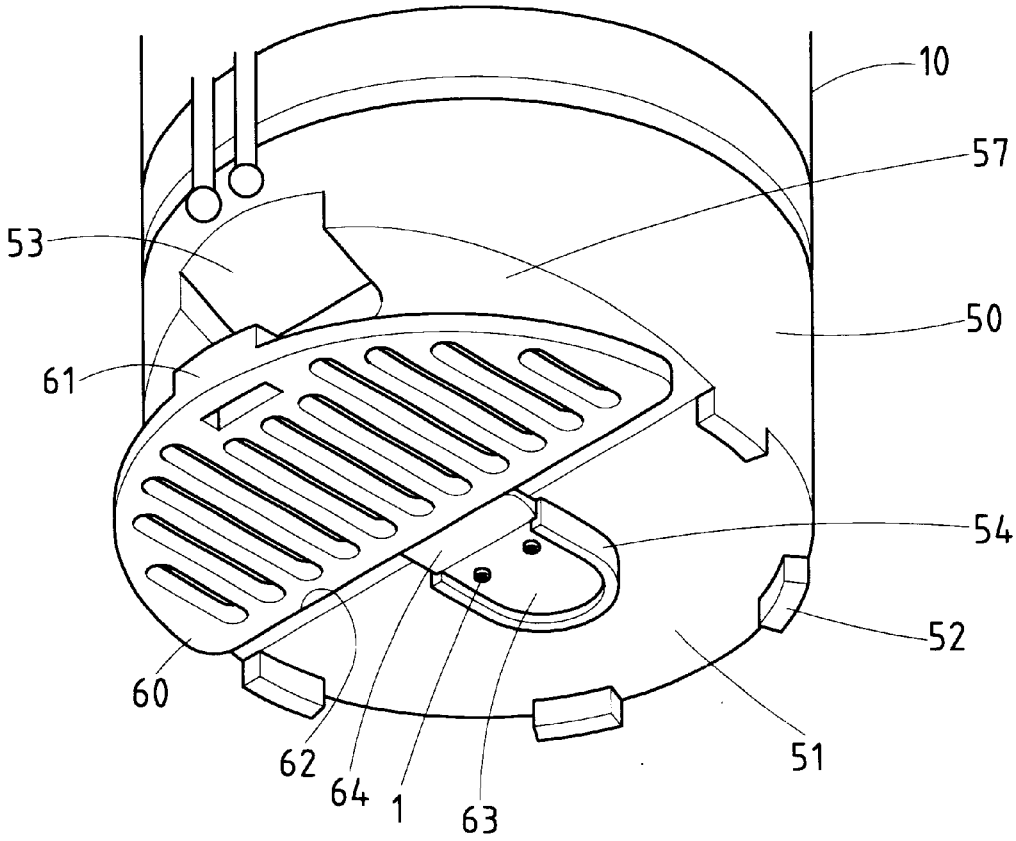
FIG. 4 shows a schematic view of the preferred embodiment of the present invention.
Figure 5:
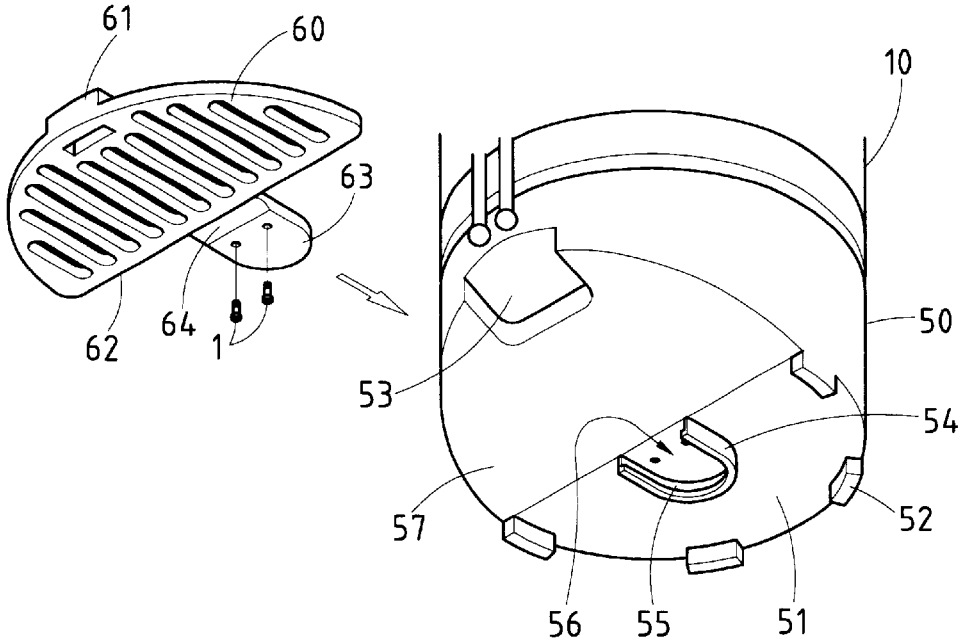
FIG. 5 shows an exploded perspective view of the preferred embodiment of the present invention.
Figure 6:
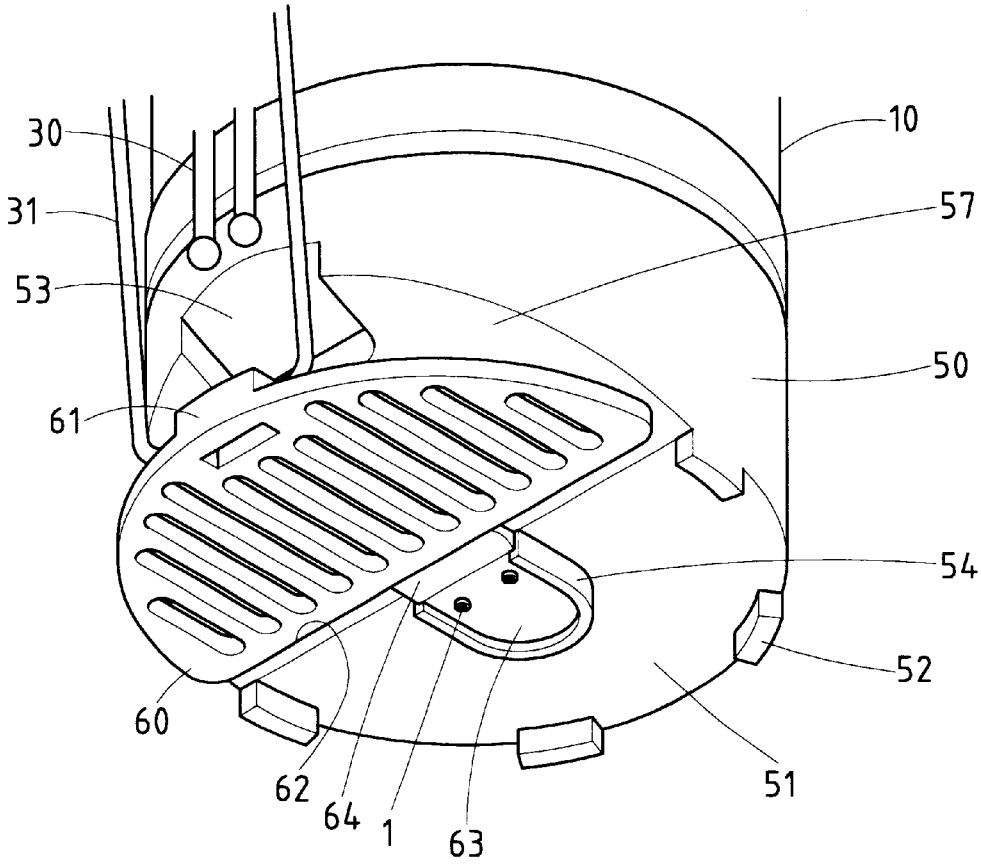
FIG. 6 shows a perspective view of the preferred embodiment of the present invention.

As shown in FIGS. 4–8, a golf bag 10 of the preferred embodiment of the present invention is provided with a tilting structure comprising a base 50, a leg frame 30, and an actuating plate 60.

The base 50 is fastened with the bottom end of the golf bag 10. The base 50 is provided in the underside with a level portion 51 which is in turn provided in the fringe thereof with a plurality of locating projections 52. The locating projections 52 are intended to locate securely the golf bag 10 on a surface. The base 50 is further provided with an inclined portion 57 contiguous to the level portion 51. The inclined portion 57 is provided with a recess 53.

The actuating plate 60 is provided with a hooked portion 61 and is fastened with the underside of the base 50 such that the hooked portion 61 is corresponding in location to the recess 52 of the inclined portion 57 of the base 50, and that the hooked portion 61 is engaged with a connection rod 31 of the leg frame 30.

Figure 7:
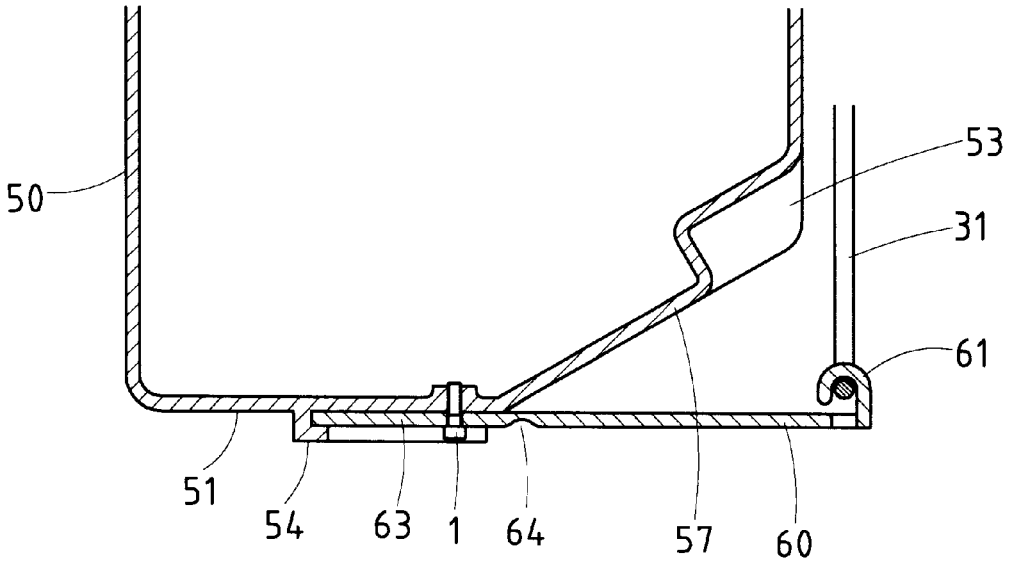
FIG. 7 shows a sectional schematic view of the preferred embodiment of the present invention.
Figure 8:
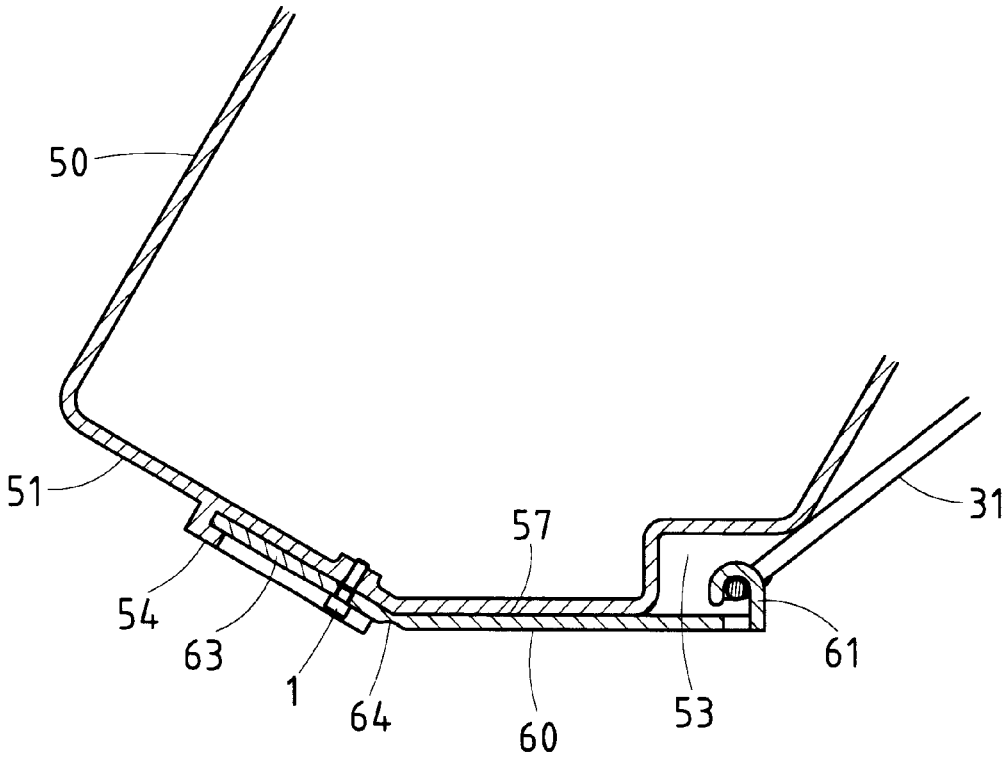
FIG. 8 shows a sectional schematic view of the preferred embodiment of the present invention in action.

The present invention is characterized by the base 50 and the actuating plate 60. The base 50 is provided in the level portion 51 with a U-shaped retaining projection 54 which is in turn provided with a U-shaped retaining slot 55. The U-shaped retaining projection 54 has an open end 56, which faces the inclined portion 57. The actuating plate 60 has a straight side 62, which is contiguous to the level portion 51 and is provided with a tongue 63 extending therefrom. The tongue 63 is provided in the underside with a depression 64 contiguous to the straight side 62 of the actuating plate 60. The depression 64 is intended to make that portion of the tongue 63 thinner in relation to the remainder of the tongue 63, so as to enable the actuating plate 60 to swivel up and down when the tongue 63 is retained in the retaining slot 55 of the retaining projection 54 in conjunction with a plurality of screws 1, which are fastened through the tongue 63 onto the level portion 51 of the base 50, as shown in FIGS. 7 and 8.

It is readily apparent that tilting structure of the present invention is relatively simple in construction as compared with the prior art tilting structure described in this specification. In addition, the actuating plate 60 of the present invention can be easily detached from the base 50 by unfastening the screws 1 so as to enable the tongue 63 of the actuating plate 60 to be pulled out of the retaining slot 55 of the retaining projection 54 of the base 50. Moreover, the actuating plate 60 of the present invention is detachably fastened with the base 50 without the use of a pivoting member.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claim.

I claim:

1. A golf bag tilting structure comprising:

a base fastened to a bottom end of a golf bag and comprised of, in an underside, a level portion, and an inclined portion contiguous to said level portion and having a recess;

an actuating plate comprised of a hooked portion and fastened to an underside of said base such that said hooked portion is corresponding in location to said recess of said inclined portion of said base; and a leg frame for supporting slantingly the golf bag on a surface, said leg frame being comprised of a connection rod which is engaged with said hooked portion of said actuating plate;

wherein said base is provided in said level portion with a U-shaped retaining projection extending therefrom, said U-shaped retaining projection comprising a U-shaped retaining slot and an open end facing said inclined portion;

wherein said actuating plate comprises a straight side opposite to said hooked portion and contiguous to said level portion, said straight side being comprised of a tongue extending therefrom and having a depression located in an underside thereof such that said depression is contiguous to said straight side whereby said actuating plate is detachably fastened to said base in such a manner that said tongue is retained in said U-shaped retaining slot of said U-shaped retaining projection of said base in conjunction with a plurality of screws, with said screws being fastened through said tongue onto said level portion of said base, said actuating plate capable of swiveling up and down in relation to said tongue, so as to actuate said connection rod of said leg frame.

* * * * *